United States Patent [19]

Armstrong et al.

[11] Patent Number: 4,647,186

[45] Date of Patent: Mar. 3, 1987

[54] BIASED SCAVENGING GRID FOR ELECTROGRAPHIC APPARATUS

[75] Inventors: Timothy G. Armstrong; Arthur S. Kroll; Frank A. Shuster, all of Rochester, N.Y.

[73] Assignee: Eastman Kodak Company, Rochester, N.Y.

[21] Appl. No.: 795,007

[22] Filed: Nov. 4, 1985

[51] Int. Cl.[4] ..... G03G 21/00

[52] U.S. Cl. ..... 355/15; 118/652; 15/1.5 R

[58] Field of Search ..... 355/15, 3 DD, 3 R; 118/652; 15/1.5; 430/125

[56] References Cited

U.S. PATENT DOCUMENTS

| | | | |
|---|---|---|---|
| 4,190,351 | 2/1980 | Macaluso et al. | 355/15 |
| 4,210,397 | 7/1980 | Macaluso et al. | 355/15 |
| 4,287,850 | 9/1981 | Yamamoto et al. | 118/657 |
| 4,349,270 | 9/1982 | Wada et al. | 355/15 |

*Primary Examiner*—R. L. Moses

*Attorney, Agent, or Firm*—Warren W. Kurz

[57] ABSTRACT

Disclosed is apparatus for scavenging charged particles (e.g. triboelectrically carrier particles) from an electrographic recording element. Such apparatus comprises a conductive grid positioned in close proximity to the path of the recording element, and biasing means for electrically biasing the grid so as to attract the charged particles from the recording element yet prevent them from depositing on, and thereby contaminating, the grid.

10 Claims, 2 Drawing Figures

FIG. 1
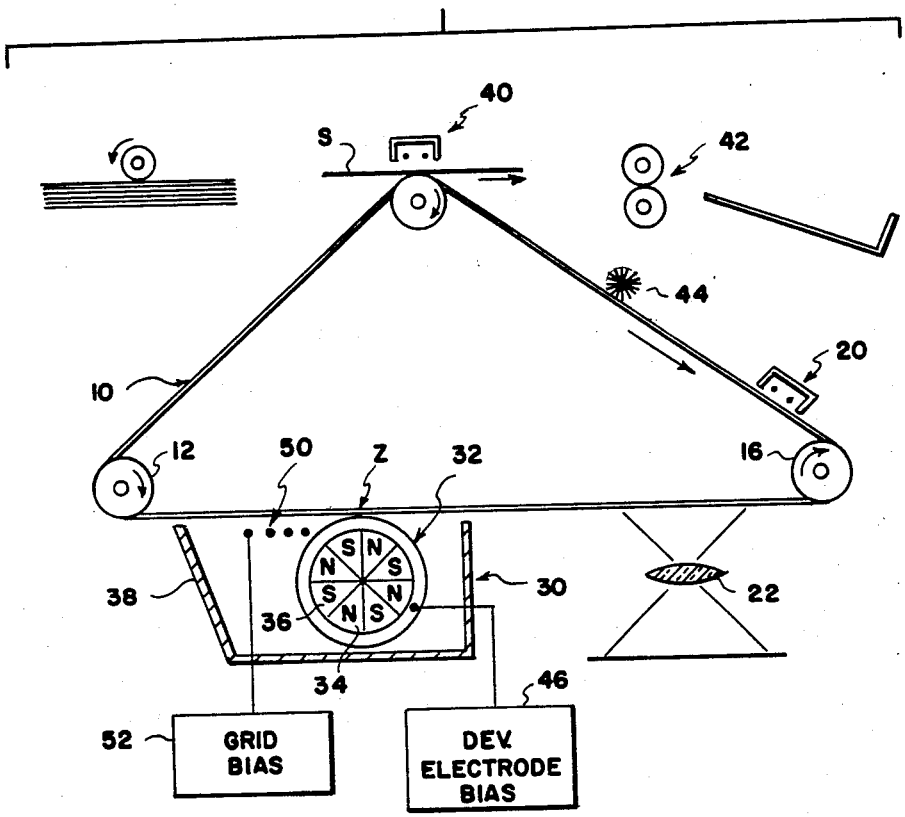
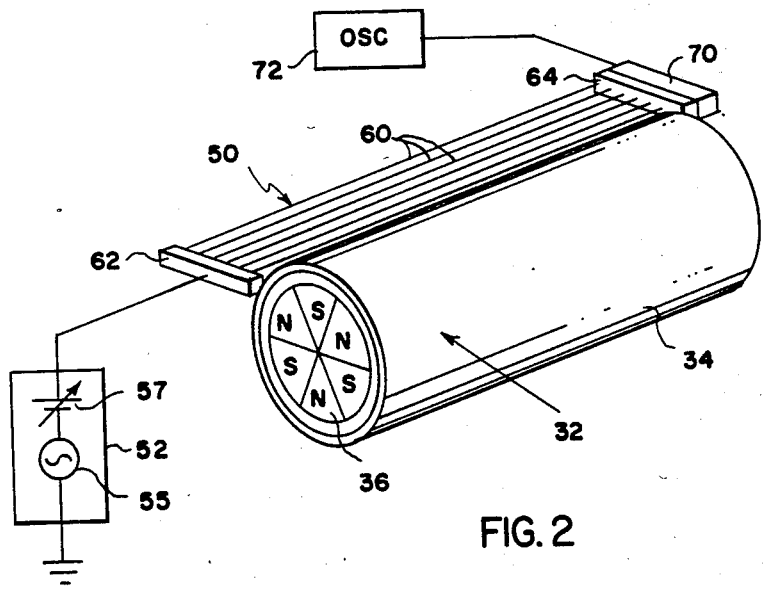
FIG. 2

BIASED SCAVENGING GRID FOR ELECTROGRAPHIC APPARATUS

BACKGROUND OF THE INVENTION

This invention relates to apparatus for scavenging charged particles from a developed electrostatic image.

In electrography, it is common to develop a latent electrostatic image borne by a dielectric or photoconductive recording element by contacting such image with a developer mix comprising magnetically attractive carrier particles and pigmented, thermoplastic particles, commonly known as toner. When mixed together and agitated, the toner and carrier particles become triboelectrically charged to opposite polarities, the polarity of the toner usually being opposite that of the electrostatic image being developed. When the developer mix is applied to the latent image (e.g. by a conventional magnetic brush applicator), the electrostatic forces associated with the image overcome the triboelectric attraction between toner and carrier, the result being that the toner is stripped from the carrier and applied to the image to effect development thereof. Thereafter, the partially denuded carrier particles are returned to a developer sump to be replenished with toner.

In conventional electrographic developing apparatus, it is common to electrically bias a development electrode, positioned directly opposite and in close proximity to the charge image, to a voltage intermediate that of the image and background areas constituting the charge image. For example, assuming those image areas which are to be developed with toner are charged to a level of, say, −500 volts, and the remaining areas (i.e. the backgound areas) are charged to a level of, say, −50 volts, the development electrode might be biased to −200 volts. In this manner, the positively charged toner particles will be attracted more toward the development electrode than toward the background areas of the electrostatic image. While this biasing scheme has the advantageous effect of preventing the deposition of toner particles in the background areas of the image, it has the undesirable effect of causing carrier particles to deposit on such areas and be carried out of the development zone with the developed image. This so-called "carrier pick-up" has an adverse effect on image quality and, worse yet, can produce deleterious effects in the form of scratches or scars in the surface of the recording element and other copier components, such as transfer and fusing rollers.

Heretofore, many schemes have been devised for scavenging charged carrier particles from the developed surface of an electrographic recording element. For example, in U.S. Pat. No. 4,349,270, there is disclosed a carrier scavenging apparatus comprising an electrically conductive member which is positioned downstream of the development zone in close proximity with the recording element's surface. Means are provided for DC biasing the conductive member to a voltage which renders it more attractive to the carrier particles than to the recording element. In this manner, the carrier particles are pulled from the recording element by stronger electrostatic forces. To remove the scavenged particles from the biased scavenging member, the latter is located relative to a magnetic brush applicator of the rotating core variety such that the particles are influenced by the rapidly changing magnetic field produced by the rotating magnetic core. As the core rotates, the scavenged carrier particles are advanced by magnetic forces along the surface of the scavenging member to a position at which they return to the development sump under the force of gravity.

In scavenging apparatus of the above type, it can be difficult to rid the biased scavenger member from the electrostatically-attracted carrier particles. This is especially true when a DC bias is applied to the scavenging member. Moreover, as the scavenging member becomes contaminated with the scavenged particles, the applied bias becomes increasingly less effective in attracting the particles to the scavenging member.

SUMMARY OF THE INVENTION

An objct of this invention is to provide scavenging apparatus of the type described which, upon scavenging undesired charged particles from the surface of the recording element, is less apt to become contaminated by the scavenged particles.

According to the invention, there is provided a charged particle scavenging apparatus comprising a grid structure comprising a plurality of substantially parallel, non-magnetic, electrically conductive wires. According to a preferred embodiment, this grid is connected to an AC power supply which is preferably DC-biased to a polarity opposite that of the charged particles to be scavenged. The scavenging grid is positioned in close proximity to the path of the recording element, downstream of the development zone. The AC grid bias functions to alternately attract the charged particles from the recording element and toward the grid, and then repel such particles from the grid itself, thereby reducing grid contamination. The preferred DC offset bias serves to provide a stronger electric field for scavenging particles from the recording element than for preventing grid contamination. Being composed of a plurality of spaced wires, the biased grid, will allow the scavenged particles to pass (or be pulled) through the grid by the magnetic influences of a magnetic brush applicator and/or gravity to a reservoir or sump positioned directly beneath the grid.

The invention and its various advantages will be better understood from the ensuing detailed description of a preferred embodiment, reference being made to the accompanying drawings.

BRIEF DESCRIPTION OF THE DRAWINGS

FIG. 1 is a schematic illustration of an electrographic document copying apparatus embodying the invention; and FIG. 2 is a perspective view of a preferred embodiment of the invention.

DETAILED DESCRIPTION OF PREFERRED EMBODIMENTS

Referring now to the drawings, FIG. 1 schematically illustrates an electrophotographic document copying apparatus embodying the invention. Such apparatus comprises an endless photoconductive recording element 10 which is trained around three rollers 12, 14 and 16, one being rotatably driven to advance the recording element in the direction of the arrow. Typically, recording element 10 comprises a photoconductive layer disposed on a conductive support, the latter being electrically grounded. During advancement, the recording element receives a uniform electrostatic charge (e.g. −600 volts) at corona charging station 20. Thereafter, the uniformly charged recording element is imagewise exposed at exposure station 22 to the light and dark pattern of a document D. The light pattern, corresponding to the background areas of the image, causes the uniform charge on the recording element to dissipate to, say, −50 volts, and the dark pattern, corresponding to the text or graphic image which is to be developed, causes only a slight charge dissipation to, say, −500 volts. The resulting latent charge image then advances to developing station 30 at which an electrographic developer is applied to render the image visible.

Development station 30 may comprise, for example, a conventional magnetic brush applicator 32 of the type comprising a non-magnetic cylindrical sleeve 34 having a magnetic core piece 36 rotatably mounted therein. Means (not shown) are provided for rotating the core piece in the direction of the arrow. Such movement of the core piece causes the magnetic developer to advance from a developer sump 38 to a development zone Z at which the developer contacts and develops the electrostatic image on the recording element. The developed image is then transferred to an image-receiving sheet S at transfer station 40 and fused to the receiver sheet at a fusing station 42. Thereafter, any residual developer on the recording element is removed by a cleaning station 44 and the recording element is recycled through the electrographic process.

As mentioned above, an electrographic developer is applied to the electrostatic image to render it visible at station 30. Such developer typically comprises a mixture of magnetic or magnetically attractive carrier particles, and pigmented thermoplastic particles called toner. The toner and carrier particles are triboelectrically charged to opposite polarities, the polarity of the toner particles usually being opposite the charge image. To assure that the background areas of the image remain free of toner particles after development, it is common to electrically bias the development station's development electrode, in this case the magnetic brush applicator itself, to a voltage level intermediate the respective charge levels of the background and image areas of the charge image. A development electrode bias supply 46 is shown to provide this function. While this bias supply will assure a low background density of toner particles, it also has the undesirable effect of driving the oppositely charged carrier particles toward the background areas of the image which, compared to the development electrode, appear to be positively charged. Though the carrier particles are themselves triboelectrically charged to the same polarity as the charge image, they nonetheless adhere to the background areas of the latent image after development. Such adhesion is due to an electrostatic field induced by the presence of the carrier in close proximity to the grounded recording element and, to a lesser extent, to physical forces between the carrier and the recording element's surface. Since the carrier particles are typically made of a hard substance (e.g., iron or ferrite), they can easily scratch and scar the recording element surface and it is desirable to scavenge these particles from the recording element before image transfer.

According to the present invention, a wire grid structure 50 is positioned downstream of the development zone Z and in close proximity to the recording element's surface. The grid structure is electrically connected to bias supply 52. The function of the bias supply is to produce an electric field which is effective to pull carrier particles from the developed image and direct such particles toward the grid, yet prevent such particles from lighting on the grid and thereby contaminating the same. The grid bias supply preferably comprises an AC voltage source 55 (shown in FIG. 2) having a peak-to-peak voltage of between about 400 and 800 volts, most preferably about 600 volts, and a frequency of between about 200 and 600 hertz, most preferably about 400 hertz. To produce a net movement of the scavenged particles in a direction away from the recording element, it is preferred that the AC signal provided by supply 55 be DC biased, e.g. by a variable DC voltage source 57. The polarity of the DC bias depends, of course, upon the polarity of the charged particles. Assuming the charging station 20 deposits a uniform negative charge, the toner and carrier materials are selected such that the toner and carrier particles will become charged triboelectrically to positive and negative polarities, respectively. Thus, to attract the negatively charged carrier particles toward the grid, a positive DC bias would be employed.

As regards the level of the DC offset supplied by voltage source 57, it should be such that, during at least a portion of the AC cycle, the grid becomes biased to the same polarity as the carrier particles, in this case negative. When used with a 600 volt, peak-to-peak, AC source, a +200 volt DC offset would produce an electric field that varies between −100 volts and +500 volts. When the bias of the grid is +500, it is most attractive to carrier particles. When biased to −100 volts, the grid will repel the scavenged particles, allowing them to pass through the grid to the underlying developer sump without significantly contaminating the grid.

Regarding the details of grid structure 50, it preferably comprises between five and ten wires 60 of non-magnetic, electrically conductive, material. Such wires are electrically connected and supported in a spaced, parallel fashion by a pair of conductive supports, 62, 64. Aluminum, nickel, non-magnetic stainless steel, and copper are suitable materials for wires 60. Were the wires to be magnetic or magnetically attractive, the scavenged, magnetically attractive, carrier particles would begin to contaminate the wires, reducing the effectiveness of the bias field and making it more difficult for the scavenged particles to return to the developer sump by passage through the grid. Preferably, the average diameter of each wire is between 0.1 and 1.0 mm and the spacing between adjacent wires is between 0.1 and 1.0 mm. This spacing allows the scavenged particles to pass between adjacent grid wires and thereby return to the developer sump without contaminating the grid itself. Unexpectedly, the positive DC bias applied to the AC bias signal does not cause any significant deposition or "plate-out" of scavenged particles on the grid wires. To further minimize any such plate-out, a piezoelectric transducer 70, driven by an oscillator 72 at high frequency (e.g. 400–40K Hz) may be coupled to the grid structure to mechanically vibrate the structure during the scavenging operation.

Preferably, the scavenging grid is spaced from the recording element surface between about 0.5 and 1.0 mm. A larger spacing would require a somewhat greater bias potential to produce the desired field effects. Also preferred is that the grid be closely spaced from the development zone so that the scavenged particles are within the magnetic field of the magnetic development brush and are thereby pulled through the grid by magnetic, as well as gravitational, forces.

The advantageous technical effect of the invention is that charged particle scavenging is effected without significant contamination of the scavenging apparatus and the problems attendant such contamination.

While the invention has been described with particular reference to a preferred embodiment, various alternatives and modifications will be self-evident to those skilled in the art, and such alternatives and modifications as fall within the spirit of the invention are intended to be embraced by the following claims.

What is claimed:

1. Apparatus for scavenging undesired charged particles from the surface of a moving electrographic recording element, said apparatus comprising (a) a scavenging grid comprising a plurality of spaced, electrically conductive, non-magnetic wires, said grid being positioned in close proximity path of movement of the recording element; and (b) means for electrically biasing the grid wires to attract the particles from the recording element while preventing the accumulation of such particles on the grid.

2. The apparatus according to claim 1 wherein said biasing means comprising an AC power source.

3. Apparatus according to claim 2 wherein said AC power source has a frequency within the range of about 200 to about 600 hertz.

4. Apparatus according to claim 2 wherein said AC voltage source has a peak-to-peak voltage of between about 400 and 700 volts.

5. Apparatus according to claim 2 wherein said biasing means further comprises a DC source having a polarity opposite that of the particles, and a level such that, during a portion of the AC cycle, the grid is biased to the same polarity as the particles.

6. Apparatus according to claim 4 wherein said AC voltage source has a peak-to-peak voltage of about 600 volts, and wherein said DC source has a voltage of about 200.

7. In apparatus for developing an electrostatic image on an electrographic recording element, such apparatus comprising applicator means for applying a two-component electrographic developer to the recording element to render said image visible, said developer comprising oppositely charged toner and carrier particles, the improvement comprising scavenging means for removing charged carrier particles from the recording element, such carrier particles being inadvertently applied to the recording element during development of the electrostatic image, said scavenging means comprising a conductive grid positioned in close proximity to said recording element, and means for electrically biasing the grid to alternately attract and repel carrier particles.

8. Apparatus according to claim 7 wherein the biasing means comprising a DC-biased AC power source, such bias being insufficient to prevent the AC bias signal from having the same polarity as the carrier particles during a portion of its cycle.

9. Apparatus according to claim 8 wherein the frequency of the AC source is within the range of about 200 to about 600 hertz.

10. Apparatus according to claim 7 further comprising means for vibrating said grid to minimize any tendency for the scavenged particles to adhere to said grid.

* * * * *